US005124722A

United States Patent [19]

Moriyama et al.

[11] Patent Number: 5,124,722

[45] Date of Patent: Jun. 23, 1992

[54] INK JET RECORDING METHOD

[75] Inventors: Jiro Moriyama; Masahiro Takei, both of Yokohama, Japan

[73] Assignee: Canon Kabushiki Kaisha, Tokyo, Japan

[21] Appl. No.: 701,378

[22] Filed: May 13, 1991

Related U.S. Application Data

[63] Continuation of Ser. No. 358,508, May 30, 1989, abandoned, which is a continuation of Ser. No. 207,936, Jun. 17, 1988, abandoned, which is a continuation of Ser. No. 65,390, Jun. 23, 1987, abandoned.

[30] Foreign Application Priority Data

Jun. 25, 1986 [JP] Japan ..... 61-149080

[51] Int. Cl.[5] ..... B41J 2/04

[52] U.S. Cl. ..... 346/1.1; 346/140 R

[58] Field of Search ..... 346/1.1, 140

[56] References Cited

U.S. PATENT DOCUMENTS 4,409,596 10/1983 Ishii ..... 346/1.1
4,475,113 10/1984 Lee ..... 346/1.1
4,523,200 6/1985 Howkins ..... 346/1.1
4,562,445 12/1985 Rich ..... 346/140
4,625,221 11/1986 Mizuno ..... 346/140
4,646,106 2/1987 Howkins ..... 346/1.1
4,743,924 5/1988 Scardovi ..... 346/140

*Primary Examiner*—Joseph W. Hartary
*Attorney, Agent, or Firm*—Fitzpatrick, Cella, Harper & Scinto

[57] ABSTRACT

An ink jet recording method comprises a recording head for discharging ink in response to a signal to be applied thereto to perform the recording; and drive unit for driving said recording head at each of a plurality of drive frequency, wherein at least one drive frequency is above a stable discharge speed region and the discharge speed of ink at which ink is discharged in the drive frequency being equal to the discharge speed at which ink is discharged in the drive frequency of the stable discharge region.

3 Claims, 3 Drawing Sheets

INK JET RECORDING METHOD

This application is a continuation of application Ser. No. 07/358,508 filed May 30, 1989, which is a continuation of application Ser. No. 07/207,936 filed Jun 17, 1988, which is a continuation of application Ser. No. 07,065,390 filed Jun. 23, 1987, all now abandoned.

BACKGROUND OF THE INVENTION

1. Field of the Invention

The present invention relates to an ink jet apparatus having a stable and high discharge speed.

2. Related Background Art

In an ink jet printer which supplies an electrical signal to an electro-mechanical transducer to discharge ink, an on-demand type ink jet printer which discharges ink only when an input signal is applied has been known.

A physical construction of major portions of such an ink jet printer is shown in FIG. 5.

In FIG. 5 numeral 1 denotes a platen which is rotated by a line feed pulse motor 7 to feed a record sheet, not shown. The presence or absence of the record sheet is detected by a sheet sensor 9. Numeral 2 denotes an ink jet recording head which has a plurality of ink discharge nozzles 30, is provided on a carriage slidably arranged on a guide bar, not shown and is movable along the platen 1 through a belt 14 by the drive of a D.C. carriage motor 8. In order to detect the position of the recording head 2, a linear encoder 12 and an encoder sensor 13 are provided, and in order to detect a home position, a home position sensor 11 is provided. In order to recover failure of ink discharge by the nozzles 30 of the recording head 2. an ink absorbing cap 3 which is movable by the drive of an auto-cap motor 6 is provided and the position of the cap 3 is detected by a cap sensor 10.

The control of the ink jet printer of such a construction is effected by a known CPU 20 in a control system shown in FIG. 1. The CPU 20 effects the following control operations in accordance with control inputs applied by switches 21 on a console panel, not shown. It refers inputs from the encoder sensor 13 and the home position sensor 11 to drive a carriage motor 8 through a DC servo forward/backward switching circuit 22 and drive a line feed motor 7 through a pulse motor drive circuit 23, and reads out data from a record data memory D to get a drive frequency as shown in FIG. 4 and supplies it to a head driver 24 by which the recording head 2 is driven. It also controls other units, not shown, in accordance with inputs from other sensors.

When a print switch of the switches 21 is depressed, the record operation is started. The presence of the record sheet is detected by the sheet sensor 9 and the line feed motor 7 is driven by several steps so that the platen 1 is rotated one revolution and the record sheet is set at a record start position. Then, the carriage motor 8 is driven so that the recording head 2 is reciprocally driven, and the line feed motor 7 is driven in synchronism therewith to feed the record sheet line by line. During this period, a drive signal is applied to the recording head 2 from the head driver 24 in accordance with record data so that the recording head 2 is driven and ink droplets d are discharged from the recording head 2 and characters or images are recorded on the record sheets.

A relationship between a drive frequency f discharge of the recording head 2 of the ink and a discharge speed v of the ink is shown in FIG. 4.

In order to reduce a print time, the drive frequency f may be raised. But, as seen from FIG. 4, the discharge speed v changes as the drive frequency f rises.

As shown in FIG. 4, the characteristic of the drive frequency f has a region I in which the discharge speed v does not change with the drive frequency f and a region II in which the discharge speed v changes with the drive frequency f. In order to attain a high quality of print, a drive frequency $f_n$ which meets relationships of $$\frac{1}{2}f_1 = f_2, \frac{1}{3}f_1 = f_3, \ldots, \frac{1}{n}f_1 = f_n$$

where $f_1$ is a reference frequency equal to a maximum in the region I and n is an integer equal to or larger than 2, is used.

Accordingly, when the drive frequency f is to be increased, the characteristic of FIG. 4 is determined by a structure of the recording head 2, a property of material of the ink and a head drive waveform.

Where the region II in which the discharge speed v is not constant is used, a deviation l from the ink discharge point changes to l' when the ink discharge speed v changes to v + Δv, and an ink deposit point is deviated by $$\Delta l = l' - l = L\frac{V}{v + \Delta v} - L\frac{V}{v}$$

where L is a distance between the record medium and the record head 2 and V is a main scan speed of the record head 2.

Further, as the discharge speed v changes, a volume of ink droplet changes and there is a correlation between those two.

For this reason, when the region in which the ink discharge speed v changes with the drive frequency f is used, the quality of print is degraded.

SUMMARY OF THE INVENTION

It is an object of the present invention to provide an ink jet apparatus which drives a head at a high drive frequency without degrading a print quality so that a print time is shortened.

In accordance with the present invention, an ink jet apparatus having drive means for discharging ink by driving the head at a plurality of drive frequencies is provided in which the drive means has at least one drive frequency which is beyond the region in which a stable discharge speed is attained and at which a stable discharge speed is independently attained.

DETAILED DESCRIPTION OF THE PREFERRED EMBODIMENTS

Figure 1:
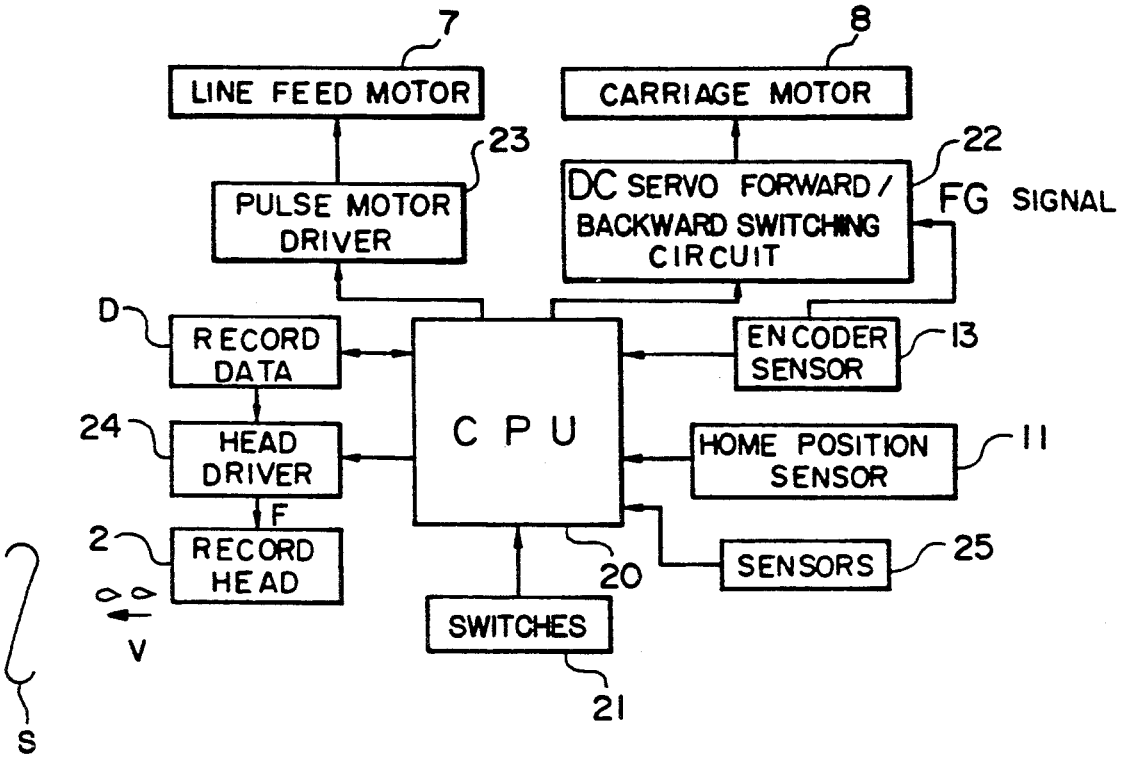
FIG. 1 PRIOR ART
FIG. 1 shows a block diagram of a printer control unit.
Figure 2:
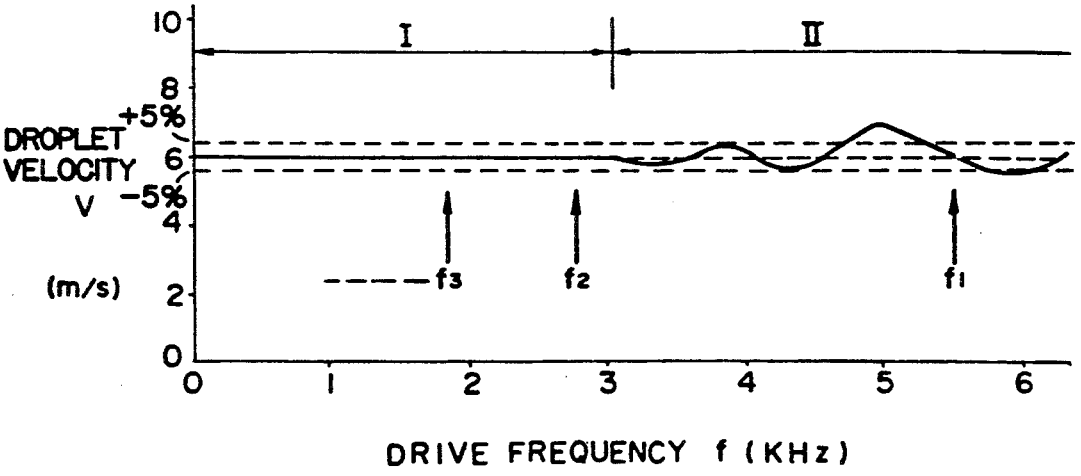
FIG. 2 shows a graph a drive frequency, a discharge speed and a deposit point.
Figure 3:
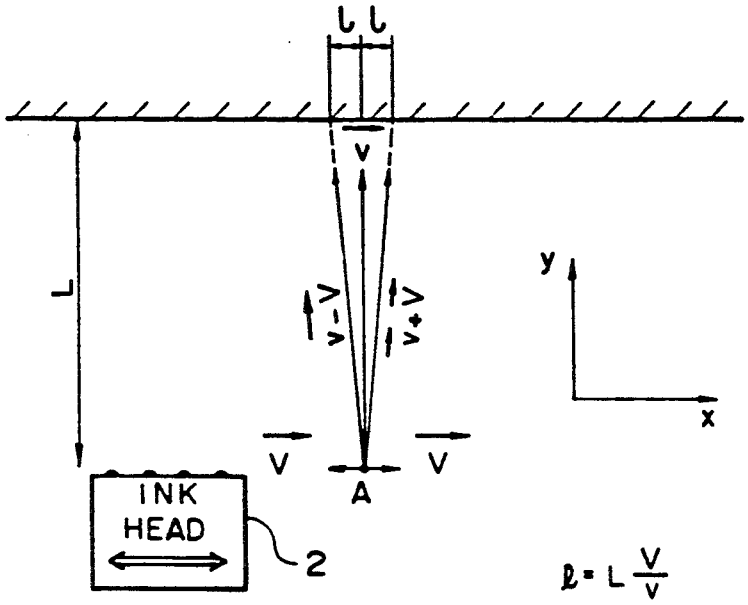
FIG. 3 shows an ink discharge speed and a deviation of the deposit point.
Figure 4:
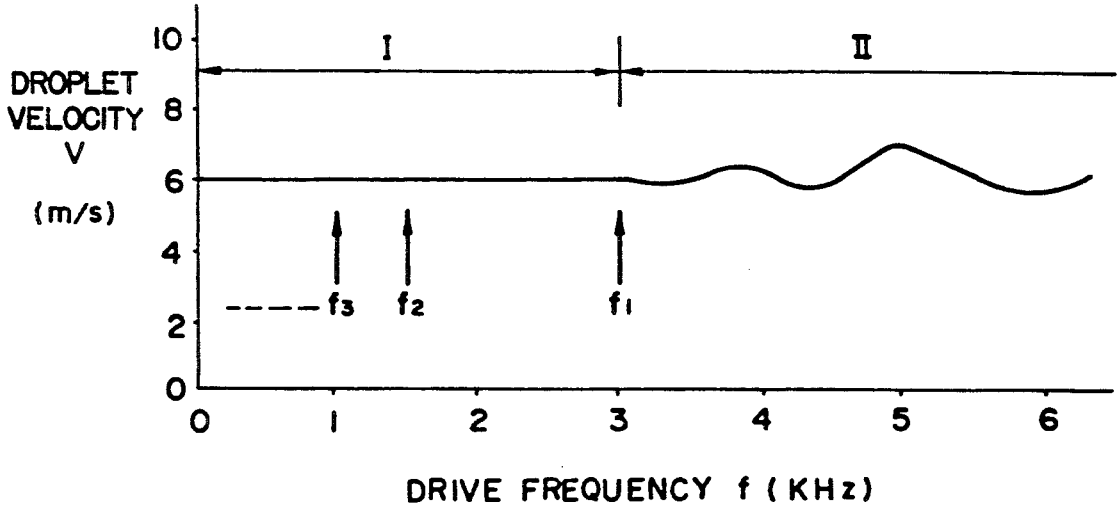
FIG. 4 PRIOR ART
FIG. 4 shows a relationship between a drive frequency and an ink discharge speed in a prior art apparatus.

FIG. 2 shows a relationship between a drive frequency f and an ink discharge speed v in an ink jet printer in accordance with the present invention. A physical construction of major portions of the present ink jet printer may be similar to that shown in FIG. 5, and a control circuit therefor may be basically similar to that of FIG. 1, and explanation thereof is omitted.

Figure 5:
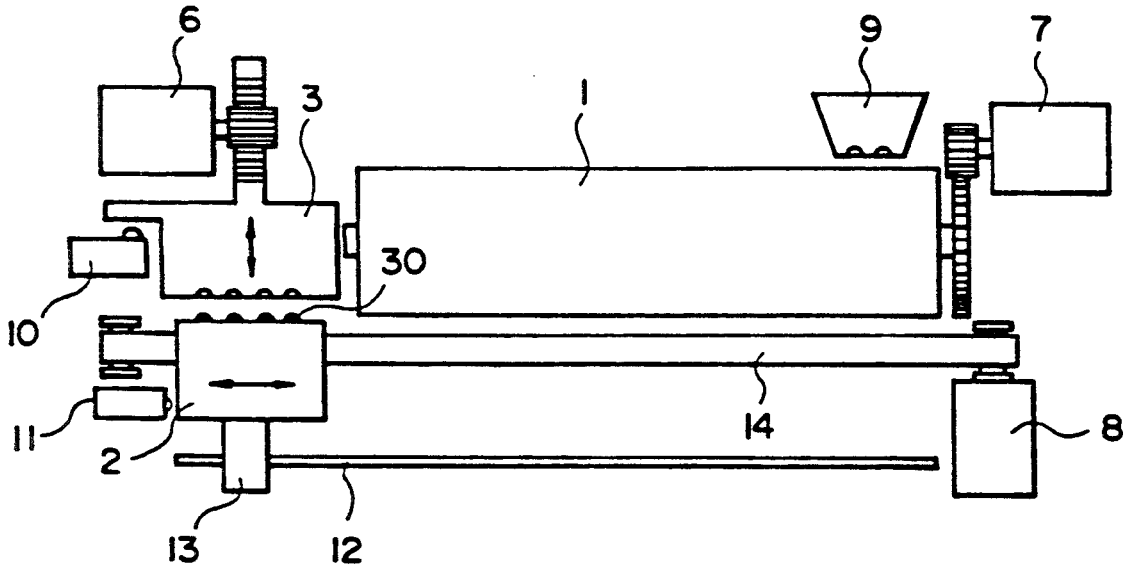
FIG. 5 PRIOR ART
FIG. 5 shows a construction of major portions of an ink jet printer.

The structure of an apparatus and a control circuit used therein according to the present invention may not be limited to a structure and a control circuit shown in FIGS. 1 and 5, and therefore, another modified apparatus capable of performing the functions described hereinafter according to the present invention may be applied.

A maximum $f_1$ of the drive frequency, which is a reference frequency, is set to a frequency which is in a region II in which the discharge speed v is variable and at which the discharge speed in the stable discharge speed region I is attained. A drive frequency $f_n$ which is 1/n of the reference frequency $f_1$ (where n is an integer equal to or larger than 2) is set to a frequency in the region I. Thus, a frequency which is approximately 1.2–2 times as high as the frequency in the prior art apparatus may be used as the reference frequency $f_1$ and the ink may be discharged stably at a high speed.

At the drive frequencies $f_1, f_2, \ldots$, no ink is discharged and hence the ink discharge speed v need not be constant for the drive frequency as it is in the region I and the drive frequencies $f_1, f_2, f_3 \ldots$ may be in the region II so long as they assure the discharge speed in the region I.

The region I may be lower than a maximum frequency at which a variation of the discharge speed v is within ± 5% for the drive frequency f, and the region II may be higher than that frequency. At the drive frequencies $f_1, f_2, \ldots f_n$, the variation of the discharge speed v should meet the above condition (± 5%). To this end, the structure of the record head property of material of the ink and head drive waveform are properly selected.

In accordance with the present invention, the drive frequency may be raised without degrading the print quality so that the print time of the ink jet apparatus is significantly shortened.

The apparatus according to the present invention can be also applied to an ink jet recording method in which the discharge speed of a liquid droplets depends on the driving frequency to be applied to driving elements, for example a method using a piezo-electric elements as an energy generating member (as shown in U.S. Pat. No. 3,832,579) and a method using an electro-thermal conversion element (as shown in DE-OS 2843064).

In the above embodiment and the technical explanation, "drive frequency" means a maximum drive frequency at which the liquid droplets are discharged under a maximum condition, or a standard frequency for driving.

In accordance with the present invention, the head is driven at least one drive frequency at which the stable discharge speed is independently attained, in order to discharge the ink.

We claim:

1. A recording method comprising the steps of:

scanning an on-demand type ink jet recording head adjacent a recording medium;

selecting at least one select frequency of electrical signals to be applied to a discharge element of the recording head while the recording head is scanning, the at least one select frequency being selected from a second frequency range of first and second frequency ranges, the second frequency range being greater than the first frequency range, wherein the discharge speed of ink discharged in response to electrical signals at all frequencies in the first frequency range is substantially constant, and discharge speeds of ink discharged in response to electrical signals at frequencies in the second frequency range vary as a function of frequency of the electrical signal, and the at least one select frequency is selected from the second frequency range such that the discharge speed of ink discharge in response to electrical signals at the select frequency is substantially equal to the speed of ink discharged in response to electrical signals at all frequencies in the first frequency range;

applying the electrical signals to the discharge element of the recording head, the frequency of the electrical signals being within the first frequency range or being equal to the at least one select frequency from the second frequency range; and discharging ink at a substantially constant discharge speed onto the recording medium in response to the applied electrical signals.

2. A recording method according to claim 1, wherein the discharge velocity varies within ± 5% for all frequencies in the first frequency range and for the second select frequencies of the second frequency range.

3. A recording method according to claim 1, further comprising the step of capping the recording head at a location spaced from a recording area where the recording head records on the recording medium.

* * * * *

UNITED STATES PATENT AND TRADEMARK OFFICE

CERTIFICATE OF CORRECTION

PATENT NO. : 5,124,722

DATED : June 23, 1992

INVENTOR(S) : JIRO MORIYAMA, ET AL.

It is certified that error appears in the above-identified patent and that said Letters Patent is hereby corrected as shown below:

On the title page, in item [57]

Line 6, frequency," should read --frequencies,--.

COLUMN 1:

Line 35, "recording head 2." should read --recording head 2,--.

COLUMN 2:

Line 1, "discharge" should read --of the ink discharge--;

Line 2, "of the ink" should be deleted;

Line 60, "graph" should read --graph relating to--.

UNITED STATES PATENT AND TRADEMARK OFFICE

CERTIFICATE OF CORRECTION

PATENT NO. : 5,124,722

DATED : June 23, 1992

INVENTOR(S) : JIRO MORIYAMA, ET AL.

It is certified that error appears in the above-identified patent and that said Letters Patent is hereby corrected as shown below:

COLUMN 3:

Line 50, "a" should be deleted.

COLUMN 4:

Line 9, "at least" should read --at at least--;

Line 32, "charge" should read --charged--;

Line 47, "second" should be deleted.

Signed and Sealed this

Fifth Day of October, 1993

*Attest:*

*Attesting Officer*

BRUCE LEHMAN

*Commissioner of Patents and Trademarks*